US006211617B1

(12) United States Patent
Deegan

(10) Patent No.: US 6,211,617 B1
(45) Date of Patent: Apr. 3, 2001

(54) ACOUSTO IONIC RADIO ANTENNA

(76) Inventor: Thierry Deegan, 39 Porter La., Portsmouth, RI (US) 02871-2016

( * ) Notice: Subject to any disclaimer, the term of this patent is extended or adjusted under 35 U.S.C. 154(b) by 0 days.

(21) Appl. No.: 09/417,412

(22) Filed: Oct. 13, 1999

Related U.S. Application Data

(63) Continuation-in-part of application No. 09/103,695, filed on Jun. 24, 1998, now abandoned.

(51) Int. Cl.[7] ..... H01J 19/80

(52) U.S. Cl. ..... 315/39; 315/111.21; 313/231.31; 431/2; 343/701

(58) Field of Search ..... 315/111.21, 39; 313/231.31; 431/2; 343/701

(56) References Cited

U.S. PATENT DOCUMENTS 3,586,468 * 6/1971 Sims ..... 431/1
3,914,766 * 10/1975 Moore ..... 343/701
4,061,991 * 12/1977 Hamid et al. ..... 315/39

* cited by examiner

*Primary Examiner*—Michael B. Shingleton
(74) *Attorney, Agent, or Firm*—Robert J Doherty

(57) ABSTRACT

The present invention is a plasma antenna that uses an acoustic mechanism to accelerate the ions of the plasma, causing them to radiate electromagnetic energy. A resonant acoustic chamber surrounds the plasma body to produce acoustic pressure waves of very high amplitude and ion accelerations sufficient to generate significant radiation. The resonant chamber is made of a material that is relatively transparent to electromagnetic radiation. Communications information in the form of a modulated frequency is imposed on the signal generated by the plasma by adjusting the resonant frequency of the chamber by changing a parameter of the chamber such as its length or wall stiffness. Varying the acoustic driving force may be used to modulate the amplitude of the radiated signal. Phase modulation may be implemented by lining the ends of the chamber with a material that can quickly alter the position of its reflective face.

14 Claims, 2 Drawing Sheets

ACOUSTO IONIC RADIO ANTENNA

This application is a continuation in part of Ser. No. 09/103,695 filed Jun. 24, 1998 now abandoned.

BACKGROUND OF INVENTION

Most radio transmitting antennas use electrons in a conductor to generate their radiated fields. But any charged particle, when accelerated, radiates electromagnetic energy. Electrons are generally easy to use because they are readily contained in wires and they can be accelerated with electric potentials. Typically, an electric oscillator is connected to the antenna to put a sinusoidally varying (or other appropriate) voltage on the wire. This potential causes the electrons to be accelerated at the frequency of the oscillator and produces a carrier frequency which is radiated. Modulating the frequency, amplitude, or phase of the carrier adds the communications information to the signal. Dominating the design of wire antennas in the kilohertz range and below is the limited number of electrons that can be put in a wire before resistive heating melts the wire. The currents and arrays of wires required to produce effective fields at such frequencies are very large.

Antennas may also use ions as the charge carriers. Singly charged ions carry the same charge magnitude as an electron and may be given the same acceleration as electrons to cause them to radiate exactly the same electromagnetic energy as electrons. A body of ions can be modulated effectively with electric or magnetic means to produce the same modulated carrier as from the electric wire antenna. The strength of electric and magnetic fields required to modulate ions is greater than that required to modulate electrons because ions have more mass. The typical ion antenna uses a resonance of a molecular ion to generate microwave frequencies.

The present invention uses hydrodynamic acceleration of the ions. It does so by entraining the ions in a neutral gas and inducing a desired acoustic motion through the gas. The ions, by being the same size and having a mass similar to the surrounding gas molecules are carried by the neutral gas which imposes its bulk motion on the ions. The acoustic field in the gas is a propagating sequence of waves of acceleration. The acoustic accelerations of the gas also accelerate the ions and cause them to radiate in proportion to the acceleration. This mechanism is suitable for generating frequencies up to that determined by the speed of sound in the chamber.

A significant benefit of the plasma antenna is that a greater number of ions can be generated in a plasma volume than the number of electrons that can be induced in the skin of a wire. In addition, a compact plasma container can take advantage of the major benefit of vertical orientation in launching radiation into the earth-ionosphere waveguide. Ion density and vertical orientation allow a plasma antenna with a volume of a few cubic meters to rival the performance of existing electronic antennas that are tens of kilometers in length for the lowest frequencies. The ion antenna also eliminates the problems of the ground connections of ground-loop antennas, and by reducing the local electric field, eliminates the need for environmental monitoring and the impact on local utilities.

The mechanism of the present invention overcomes the problems of wire antennas operating in the Extremely Low Frequency (ELF) (30 to 300 Hz) range, for example. Each of the existing ELF transmitter antennas has a dipole moment of $6.6\times10^6$ ampere-meters. Approximately 10 cubic meters of a plasma with an ion density of $10^{20}$ ions per cubic meter to launch an equally effective electromagnetic wave into the atmosphere. Such densities of ions are produced routinely in experimental magneto-hydrodynamic generator flames that are seeded with materials of low ionization potential. The heat of combustion provides enough molecular energy to strip an outer electron from neutral atoms. An additional example of a mechanism to generate ions is with an arc discharge.

The amount of energy needed for ionization (and the resulting ionization fraction for a given temperature) depends on the atom species used for the ions. Cesium, rubidium, sodium, and potassium have low ionization potentials and can yield ionization fractions on the order of $10^{-4}$. Using such seed materials gives the flame an ion density in the range required for the acousto-ionic transmitter. The seeded flame produces the charge carriers that must be accelerated to make a carrier frequency which is, in turn, modulated to support communications.

Accelerating the ions in the stream can be accomplished by physically moving them by any number of mechanical means such as having the combustion chamber resonate in the manner of an organ pipe at the desired carrier frequency. For electromagnetic signal propagation to occur, the ions must be in the open air or in a container that is relatively transparent to electromagnetic waves. An organic-matrix composite material reinforced with non-conductive fibers such as glass can be used if it is internally insulated or actively cooled to protect it from the heat of the combustion gas. Small chambers with relatively high frequencies may be made with monolithic materials such as fused quartz that are resistant to the hot gas. In order to obtain the greatest acceleration of ions, the resonant frequency of the pipe is made to coincide with the natural frequency of the gas body in the pipe. The chamber is mounted such that it is rigidly affixed to a massive foundation so as to allow the chamber to flex in the desired mode of vibration. For example, if the longitudinal mode of vibration is desired, then the chamber is mounted with one end firmly anchored and the other end free to move longitudinally. A sliding anchor or an attachment with a two-pinned link allows the required motion. If radial motion is desired, then the main anchor is placed on one side of the chamber so as to allow the chamber to bulge radially at all other locations on its circumference. A chamber designed to have both longitudinal and radial frequencies coincident with that of the gas body provides optimum signal generation.

A shape superior to the organ-pipe uses the acoustic reflectivity of the chamber's walls to concentrate acoustic waves to a focus. The high intensity of acoustic pressure is accompanied by large molecular accelerations and usable radiation. The shape is essentially that of an ellipsoid. The end bells reflect acoustic energy to a large intensity at the foci of the ellipse. The acoustic energy to overcome losses is supplied by an attached horn that applies input energy in step with the resonant wave motion in the ellipse. The ions at the foci experience large accelerations and radiate electromagnetic power according to Larmor's formula.

$$\text{Power} = \frac{q^2 acc^2}{6\pi\varepsilon_0 c^3}$$

Where q=charge acc=acceleration $\delta_o$=permittivity of free space c=speed of light The frequency of the acoustic tone of the organ-pipe chamber and the resulting frequency of the radiated carrier can be modulated by changing the resonant frequency of the pipe. This is accomplished by changing the length of the pipe, the impedance at the exit, or the stiffness of the pipe's wall. The longitudinal resonance of the chamber is proportional to its length, diameter, and wall thickness. The length may be changed by having more than one set of anchors near one end. The lowest frequency of the chamber is excited when the anchor that offers the longest free distance between the anchor and the free end is available. A higher frequency is generated when an anchor that is intermediate in distance restrains the chamber. Mechanical actuation of anchor position, that is, coupling and decoupling the intermediate anchor, causes the resonant frequency of the chamber to be modulated between the lower and the higher frequencies. This technique is the same as the finger restraint on the strings of a guitar at the frets on its fingerboard.

Modulation of the radial frequency may be accomplished with radial anchors, as in an analogy to the case of the longitudinal frequency, or the stiffness of the wall may be changed with circumferential bands that are coupled or decoupled, as needed. When the bands are not snug on the chamber, the frequency of the chamber is low. Actuating the bands to grip the chamber adds the stiffness of the bands to that of the wall of the chamber and increases the frequency. Actuators may be electro-mechanically operated. A more direct and rapid action results if a piezo-electric actuator is used.

Changing the resonant frequency of the gas may be accomplished by adjusting the geometry of the exit path from the gas chamber. The restricted opening acts as a nozzle and establishes the impedance mismatch between the inside of the pipe and the open air that induces longitudinal reflections, which excite all the other modes of vibration of the system. Changing the diameter of the throat changes its impedance and the resulting excitation frequency. The geometry of the throat may be changed by making it sufficiently flexible to have its generally round shape deflected to an oval. The impedance of the oval is different enough from that of a circle to change the resonant frequency of the chamber. A potentially simpler mechanism can impose a small flapper in the throat. However, such a mechanism would be suitable only for a relatively slow change in frequency.

A modulation scheme that produces a shift of phase in the transmitted signal requires the use of the closed, ellipsoid-shaped, resonant chamber to allow the reflective properties of the walls to be manipulated. It is the walls that impose the phase shift on the driving gas and the driven ions.

The implementation of a modulator that shifts the phase of the fixed-frequency carrier requires a reflective surface that can be changed quickly. A normal reflection from a large mismatch of acoustic impedance causes a 180-degree phase shift in an incident wave. Moving the wall toward or away from the incident wave at a speed faster than the speed of sound in the chamber causes an apparent phase shift of the reflection. Mechanically actuating the position of a barrier so quickly is difficult, although an alternative is available. It consists of a surface with an adjustable acoustic impedance. The surface is a reflector body made of an electro-rheological fluid, a material that changes its bulk modulus, and thereby its acoustic impedance, with the application of an electric field.

DESCRIPTION OF PRIOR ART

Where the majority of existing antennas employ the electron as the charge carrier, a few use ions. Such plasma antennas use electrostatic and magnetic means to accelerate the ions or to excite them to oscillate between two energy states. This type of antenna generally operates at the resonance frequencies of the plasma particles in the millions of hertz and cannot reach the low frequencies of the present invention.

Dandl's U.S. Pat. No. 4,733,133 uses an electron plasma, enclosed in a magnetic mirror containment, to produce an intense pulse of microwave energy at the electron gyrofrequency determined by the field strength of the magnetic container. By contrast, the present invention uses relatively heavy ions, rather than the much lighter electrons to generate a continuous signal, rather than pulses at the frequencies desired far below those of microwaves.

Schumacher's U.S. Pat. No. 4,916,361 uses the collision of counter-propagating electron beams to generate plasma waves which radiate electromagnetic waves at GHz frequencies. The present invention does not cause a resonance in the ions. Rather, it resonates the chamber surrounding the plasma to produce hydro-acoustic waves to accelerate the ions.

Moore's U.S. Pat. No. 3,914,766 uses a mercury plasma column as a charge-carrying and resonant component to be excited by an incident microwave signal, which is amplified by an electrostatic field imposed across the column. In addition to being inoperative at the low frequencies applicable to the present invention, Moore's device produces a lobar field pattern which is unsuitable for the omni-directional demand for ELF and VLF antennas.

BRIEF DESCRIPTION OF THE DRAWINGS

For a better understanding of the present invention and the novel features thereof, reference is made to the following descriptions to be used in connection with the accompanying drawings.

DESCRIPTION OF THE INVENTION

Figure 1:
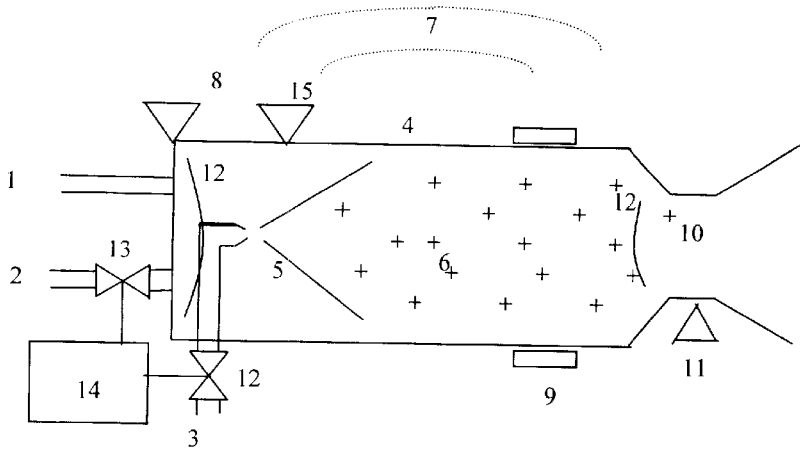
FIG. 1 illustrates a mechanically modulated, electromagnetically radiating, open-ended resonant combustion chamber.

Referring to FIG. 1, the present invention is illustrated as a complex of components that generate a plasma and modulate the ions in an enclosure. The plasma is generated by supplying fuel 1 to the combustion chamber 4 to be burned by the oxidizer 2 in a flame 5 in order to heat the seed 3. The heat of the flame and chemical processes of combustion produce ions 6 (indicated in the figure as plus signs). Acceleration of the ions in the combustion chamber causes them to radiate radio frequency energy 7 through the chamber wall, which is designed to be relatively transparent to electromagnetic energy while being sufficiently robust to contain the combustion gas. Acceleration of the ions, which is the key element of the invention, is produced by the action of the non-ionized portion of the gas in the chamber. Hydro-acoustically, the ions act as ordinary constituents of the gas in the chamber. They respond to acoustic waves as any molecule or atom, that is, in proportion to their size and mass and in response to the viscosity of the gas. They are accelerated by any waves 12 in the chamber as they reflect from the throat 10 and the back end of the chamber. The resonance of the chamber causes acoustic waves in the chamber to have a fixed frequency and a large amplitude. The resonance is established by tailoring the size and shape of the chamber to have the chamber's natural frequency at the desired transmission frequency.

FIG. 1 also illustrates several schemes for mechanically modulating the chamber of an open-ended resonant antenna, any one of which may be used individually or in concert with others illustrated or similar means which those skilled in the art may apply. The object of all of these mechanisms is to change the chamber's resonant frequency. The effect of such a modulation is a shift of frequency from one resonant frequency to another resonant frequency. This produces the equivalent of a frequency-shift keyed signal, with the two frequencies representing mark and space, in the parlance of the telecommunications industry. Such a modulation may be implemented in the open-ended chamber by changing its effective length. This is done by having fixed anchor ties 8 and other anchors 15 that can be relaxed or engaged. The effective length of the chamber is shortened and the resonant frequency raised by engaging anchor 15. The lower frequency is restored by disengaging anchor 15 and allowing the full length of the chamber, from the throat 10 to the tail anchor 8 to participate in the tone.

The chamber's frequency may also be changed in stiffness with perimeter bands 9 along its length. Having the bands tightened increases the effective stiffness of the wall and increases the chamber's frequency.

The resonance frequency of the chamber may also be changed by modifying the geometry of the throat 10 with a flexible restrictor 11. Such a device is intended to change the restriction of the throat and alter the flow impedance of the throat. The change in throat impedance alters the reflectivity of the throat and changes the acoustic length and thus the resonant frequency of the chamber.

The transmitter can be modulated in an amplitude-modulation mode by using seed control valve 12 to modulate the amount of seed passed into the chamber. The amount of seed controls the number of ions in the combustion chamber at any moment and reducing the amount of seed causes the amplitude of the radiated signal to be decreased. Similarly, since the degree of ionization of the seed is a function of the temperature of the combustion gas, reducing the combustion process by throttling down the amount of fuel, oxidizer, or both will alter the temperature of the combustion gas and the number of ions generated per unit time. Since the ions cause the radiation to be produced, reducing or increasing their number, changes the amplitude of the radiated signal. Thus an oxidizer supply valve 13 is an example of one means to modulate the temperature of the plasma and the number of ions in the chamber and, thus the amount of ion-generated emissions. These valves are operated by a modulator mechanism 14 that is used to control the position of the valves and the resulting amplitude of the electromagnetic signal produced by the antenna.

Figure 2:
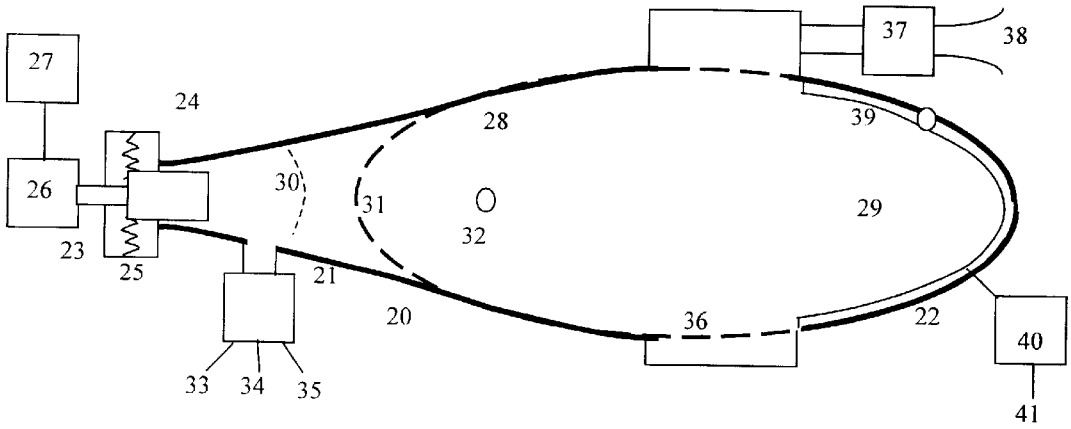
FIG. 2 shows a closed-chamber embodiment of the invention, which uses a shaped reflector to focus the acoustic energy in the plasma.

The alternative embodiment of the invention is illustrated in FIG. 2. It consists of a chamber that is sufficiently closed to keep the acoustic waves that are acting upon the plasma confined. This eliminates one of the drawbacks of the embodiment of FIG. 1, in that the energetic combustion gas exits the chamber with a large amplitude acoustic component at the resonant frequency of the chamber. In order to have a usably large electromagnetic signal, this acoustic component will be objectionably strong in the near vicinity. For a tactical naval application of the invention, in which the object of the device is to generate signals for warships to communicate with submerged submarines, the noise and thermal plume of what is, in essence, a vertically oriented anchored rocket engine are quite detrimental. The alternative embodiment focuses the acoustic energy in the plasma and does not release it to the surroundings. It does so with the shaped chamber 20. The chamber has two main parts, comprising a generator horn 21 and the elliptical reflector 22. An input signal generator 23, illustrated as a piston 24 sealed by a diaphragm 25 and driven by a magnetic voice coil 26, may be controlled by any suitable means 27 so as to apply an acoustic input to the gas 28 in the chamber.

The wave 30 generated by the input signal generator propagates down the horn 21 to enter the reflector 22. The wave is then focused by the elliptical shape of the reflector to the focus 24 of the ellipse. At the focus the amplitude of the acoustic wave is very high and causes the ions in the vicinity to be accelerated. There are several non-linearities in the transition from the signal generator to the horn and from the horn to the ellipse so that the focusing effect is spread over a large enough volume of the chamber for a significant number of ions to be involved. It is this volume that is the predominant source of the radiation generated. The volume of strong acceleration is smaller in this embodiment than in the open-ended chamber, but the power radiated is a function of the square of the acceleration. With acoustic intensity and the resulting acceleration of the gas a cubic function at the focus, the smaller radiating volume produces a far greater electromagnetic signal than in the organ-pipe geometry. The resonance-enhancing shape also takes the dissipated wave after it passes through the focus and reforms it in the horn end of the chamber. An elliptical screen 31 reconcentrates much of the energy in the second focus 32. Penetrations in the screen allow energy from the input signal generator to replace that lost in wall losses and viscosity in the gas. The space behind the screen provides a space for the combustion gas to be generated from the inputs of fuel 33, oxidizer 34, and seed 35. A portion of the transition section 36 between the horn and the reflector may be made porous to provide an exhaust path for spent gas. This gas may be passed through a seed recovery mechanism 37 before a final exhaust output 38.

The modulation techniques that may be applied to the closed chamber include the same amplitude modulation techniques of seed control and temperature control that are described in the embodiment of FIG. 1. Frequency modulation and amplitude modulation are performed by adjusting the signal that drives the voice coil 26 of the input signal generator. Phase modulation is performed by applying an electro-rheological coat 38 to the inside of the reflector. The acoustic impedance of the coat is controlled by the output from a voltage source 39. A dynamic control signal 40 to this voltage source adjusts the impedance of the reflector and causes a shift in phase when the wave 30 reaches the focus 24.

Figure 3:
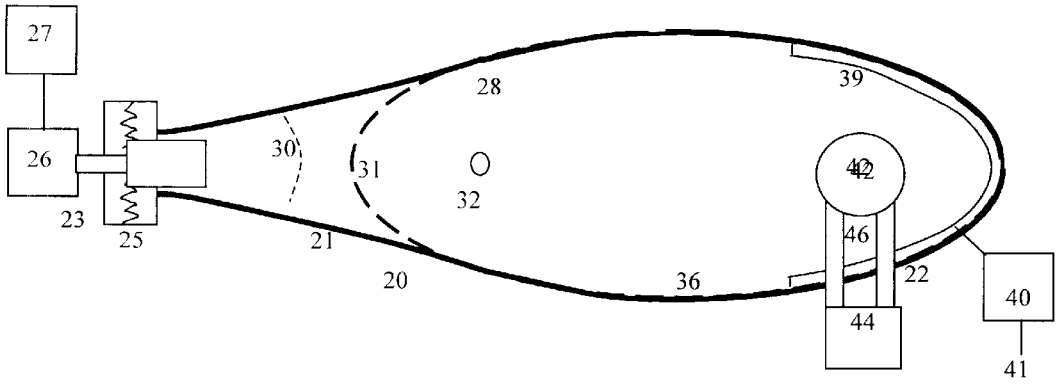
FIG. 3 illustrates an embodiment that does not rely on combustion heat to generate the ions and confines the plasma to a small volume in an acoustic acceleration chamber.

FIG. 3 shows a closed acoustically resonant chamber, as in the embodiment of FIG. 2, but includes an inner chamber 42 to contain the plasma. An ion generator 44, common to the art, is connected to the ion chamber and produces a continuous supply of ions for the chamber through a circulation path 46. The ion chamber 42 consists of an acoustically thin material or a magnetic trap which holds the ions and allows the acoustic wave 30 to penetrate and accelerate the ions. Modulation of the signal in this embodiment is the same as for the other embodiments and includes further options available in the art to modulate signal amplitude through control of the concentration of ions produced by the ion generator.

Having described the invention, what is claimed as new is:

1. A radio frequency transmitter which relies on the acoustic acceleration of ions to generate a radiated electromagnetic signal, said transmitter comprising:

a combustion chamber whose walls allow electromagnetic energy to pass through, a fuel supply, a source of oxidizer to bum the fuel, a supply of ion seed material, a burner which produces a jet flame from the supply of fuel, oxidizer and dispersed seed, a mechanism to modulate the supply of seed material to change the quantity of ions in the flame, so as to modulate the amplitude of the frequency generated.

2. The transmitter of claim 1 wherein a modulator mechanism is applied to the supply of oxidizer to change the temperature of said flame produced and thereby the resulting ion fraction in the combustion chamber, so as to modulate the amplitude of said signal.

3. The transmitter of claim 1 wherein the geometry and scantlings of said combustion chamber are configured to have said chamber resonate at a desired frequency.

4. The transmitter of claim 3 wherein the mechanical resonance of said combustion chamber and the resulting radiated frequency are modulated by changing the effective length of the said chamber.

5. The transmitter of claim 3 wherein the mechanical resonance of said combustion chamber and the radiated frequency are modulated by changing the stiffness of the wall of said combustion chamber.

6. The transmitter of claim 3 wherein the mechanical resonance of said combustion chamber and said radiated frequency are modulated by changing the geometry of the exhaust throat of said chamber.

7. The transmitter of claim 3 wherein the geometry of said combustion chamber is tailored to have acoustic waves from an input signal generator concentrated at a focus.

8. The transmitter of claim 7 wherein an amplitude modulation control is applied to said input signal generator.

9. The transmitter of claim 7 wherein a frequency modulation control is applied to said input signal generator.

10. The transmitter of claim 7 wherein a material with an adjustable acoustic impedance is applied to the inside of said combustion chamber so as to allow a phase-shift to be imparted to the acoustic waves in said chamber.

11. A radio frequency transmitter which relies on the acoustic acceleration of ions to generate a radiated electromagnetic signal, said transmitter comprising:

an ion supply, an ion container transparent to acoustic waves an input signal generator an acoustic chamber wherein the geometry of said combustion chamber is tailored to have acoustic waves from the input signal generator concentrated at a focus and whose walls allow electromagnetic energy to pass through, and a mechanism to modulate the supply of ions to the ion container, so as to modulate the amplitude of said signal generated.

12. The transmitter of claim 11 wherein a modulator is applied to said input signal generator to control the amplitude of said signal.

13. The transmitter of claim 11 wherein a modulator is applied to said input signal generator to control the frequency of said signal.

14. The transmitter of claim 11 wherein a material with an adjustable acoustic impedance is applied to the inside of said acoustic chamber so as to allow a phase-shift to be imparted to the acoustic waves in the camber.

* * * * *